US008801496B2

(12) United States Patent
Bunch et al.

(10) Patent No.: US 8,801,496 B2
(45) Date of Patent: Aug. 12, 2014

(54) REDUCING AGGLOMERATION OF PARTICLES WHILE MANUFACTURING A LAPPING PLATE USING OIL-BASED SLURRY

(75) Inventors: Richard D. Bunch, San Jose, CA (US); Juan Francisco Coronado Nuno, Jalisco (MX); Sergio Raul Elizalde Rojo, Jalisco (MX); Ernesto Arturo Marguez Waldthausen, Jalisco (MX)

(73) Assignee: HGST Netherlands B.V., Amsterdam (NL)

( * ) Notice: Subject to any disclaimer, the term of this patent is extended or adjusted under 35 U.S.C. 154(b) by 957 days.

(21) Appl. No.: 11/413,401

(22) Filed: Apr. 28, 2006

(65) Prior Publication Data

US 2007/0254559 A1 Nov. 1, 2007

(51) Int. Cl.
*B24B 49/00* (2012.01)

(52) U.S. Cl.
USPC ..... 451/11; 451/36; 451/60; 451/165; 451/446

(58) Field of Classification Search
USPC ..... 451/11, 36, 60, 165, 446
See application file for complete search history.

(56) References Cited

U.S. PATENT DOCUMENTS

| | | | | |
|---|---|---|---|---|
| 4,100,701 | A * | 7/1978 | Bessaguet | 451/28 |
| 5,187,899 | A * | 2/1993 | Rhoades | 451/165 |
| 5,626,640 | A | 5/1997 | Ishitobi | |
| 5,799,643 | A | 9/1998 | Miyata et al. | |
| 6,196,900 | B1 | 3/2001 | Zhang et al. | |
| 6,287,192 | B1 * | 9/2001 | Kim et al. | 451/60 |
| 6,291,350 | B1 | 9/2001 | Hashimoto et al. | |
| 6,315,644 | B1 | 11/2001 | Cho et al. | |
| 6,352,469 | B1 | 3/2002 | Miyazaki et al. | |
| 6,527,969 | B1 | 3/2003 | Tanoue et al. | |
| 6,602,108 | B2 * | 8/2003 | Griffin et al. | 451/5 |
| 6,604,849 | B2 | 8/2003 | Lin et al. | |
| 2002/0022441 | A1 | 2/2002 | Sugai | |
| 2005/0241668 | A1 * | 11/2005 | Trampuz et al. | 134/1 |

FOREIGN PATENT DOCUMENTS

| | | |
|---|---|---|
| JP | 6106478 | 4/1994 |
| JP | 11010526 | 1/1999 |
| JP | 2000-343418 | 12/2000 |
| JP | 2001277106 | 10/2001 |
| JP | 2002043261 | 2/2002 |
| JP | 2002047482 | 2/2002 |

* cited by examiner

*Primary Examiner* — Joseph J Hail
*Assistant Examiner* — Shantese McDonald

(57) ABSTRACT

Embodiments of the present invention pertain to reducing agglomeration of particles while manufacturing a lapping plate using an oil-based slurry. According to one embodiment, an oil-based slurry with particles of a known size is applied to a lapping plate. The oil-based slurry is ultrasonically mixed while applying the oil-based slurry to the lapping plate in order to reduce agglomeration of the particles.

16 Claims, 5 Drawing Sheets

REDUCING AGGLOMERATION OF PARTICLES WHILE MANUFACTURING A LAPPING PLATE USING OIL-BASED SLURRY

TECHNICAL FIELD

Embodiments of the present invention relate to manufacturing lapping plates which are used to lap sliders associated with read write heads. More specifically, embodiments of the present invention relate to using oil-based slurry to manufacture lapping plates.

BACKGROUND

Most computers use disk drives to store data. A disk drive typically includes one or more disks that the data is stored on, and read write heads that are used to write data onto the disks and to read the data from the disks. The read write head is built on a substrate which is then machined so that it has aerodynamic properties which allows the slider to "fly" over a disk. A slider flies over a location on a disk for the purpose of writing data to that location or reading data from that location.

FIG. 1 depicts a side view of a conventional slider. The slider 100 includes a write head 108 for writing data to a disk and a read sensor 106 for reading data from a disk. The read sensor 106 has a height, which is commonly known as a stripe-height 102. The air bearing surface 104 (ABS) of the slider 100 provides the aerodynamic properties that enables the slider 100 to "fly" over a disk.

In order for the slider 100 as well as the read sensor 106 and the write head 108 to function properly, the ABS 104 needs to be very flat and smooth and the read sensors 106 need to have an appropriate stripe-height 102. A lapping plate is used for grinding and/or polishing the ABS 104 (commonly referred to as the "lapping process") in order to achieve the desired smoothness and the desired stripe-height 102. A lapping plate typically has abrasive particles, such as diamond particles, on its surface that can be used to remove material from the slider 100 and/or to polish the slider 100.

The particles are typically embedded into the lapping plate surface using what is commonly known as a "charging process." Lapping plates are manufactured by placing slurry, which contains particles such as diamond particles of known size, on the lapping plate. The particles are embedded into the lapping plate using the charging process, as will become more evident.

To date, much of the industry has typically used water based slurries. However, the industry is moving toward oil-based slurries. Oil-based slurries are commonly known by the industry to have problems. For example, it is important that the particles be suspended in the slurry. However, the particles in the oil-based slurries are known to clump together (also commonly known as "agglomeration"). The agglomeration of the particles can result, among other things, in lapping plates having defects. Scratches, clumps of particles embedded into the lapping plate, and areas of the lapping plate with no embedded particles are examples of "defects." A lapping plate of inferior quality will damage sliders 100 and therefore cannot be used to lap sliders 100.

Tests have been performed on conventional lapping plates manufactured with oil-based slurries using conventional techniques to assess the quality of the lapping plates. The conventional lapping plates with five inch diameters were inspected visually using 100× magnification. The defects were counted along the respective diameters of numerous five inch conventional lapping plates. It was found that on the average the conventional lapping plates had greater than 200 defects. It was also determined that lapping plates with 100 defects or fewer were of a sufficient quality to lap sliders 100.

SUMMARY OF THE INVENTION

Embodiments of the present invention pertain to reducing agglomeration of particles while manufacturing a lapping plate using an oil-based slurry. According to one embodiment, an oil-based slurry with particles of a known size is applied to a lapping plate. The oil-based slurry is continuously ultrasonically mixed while applying the oil-based slurry to the lapping plate in order to reduce agglomeration of the particles.

BRIEF DESCRIPTION OF THE DRAWINGS

The accompanying drawings, which are incorporated in and form a part of this specification, illustrate embodiments of the invention and, together with the description, serve to explain the principles of the invention.

The drawings referred to in this description should not be understood as being drawn to scale except if specifically noted.

DETAILED DESCRIPTION

Reference will now be made in detail to various embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of the present invention, numerous specific details are set forth in order to provide a thorough understanding of the present invention. In other instances, well-known methods, procedures, components, and circuits have not been described in detail as not to unnecessarily obscure aspects of the present invention.

OVERVIEW

Through experimentation it was found that continuous ultrasonic mixing of oil-based slurry can reduce the agglomeration of particles in the oil-based slurry. Therefore, according to one embodiment, the oil-based slurry is ultrasonically mixed while applying the oil-based slurry to the lapping plate in order to reduce agglomeration of the particles. By reducing agglomeration of the particles, according to one embodiment, particle suspension in the oil-based slurry is maintained to an acceptable degree. The term "reducing agglomeration" is defined herein to include preventing the occurrence of agglomeration and separating particles that have already agglomerated. According to one embodiment, the oil-based slurry is continuously mixed. According to yet another embodiment, a relatively low frequency and/or power is used while ultrasonically mixing the oil-based slurry. For example, the oil-based slurry can be ultrasonically mixed at a frequency that is within 20 percent of 30 to 40 kilohertz. Further, the oil-based slurry can be ultrasonically mixed with ultrasonic power densities of 90 watts per cubic meter of the oil-based slurry.

AN ULTRASONIC MIXING DEVICE

Figure 1:
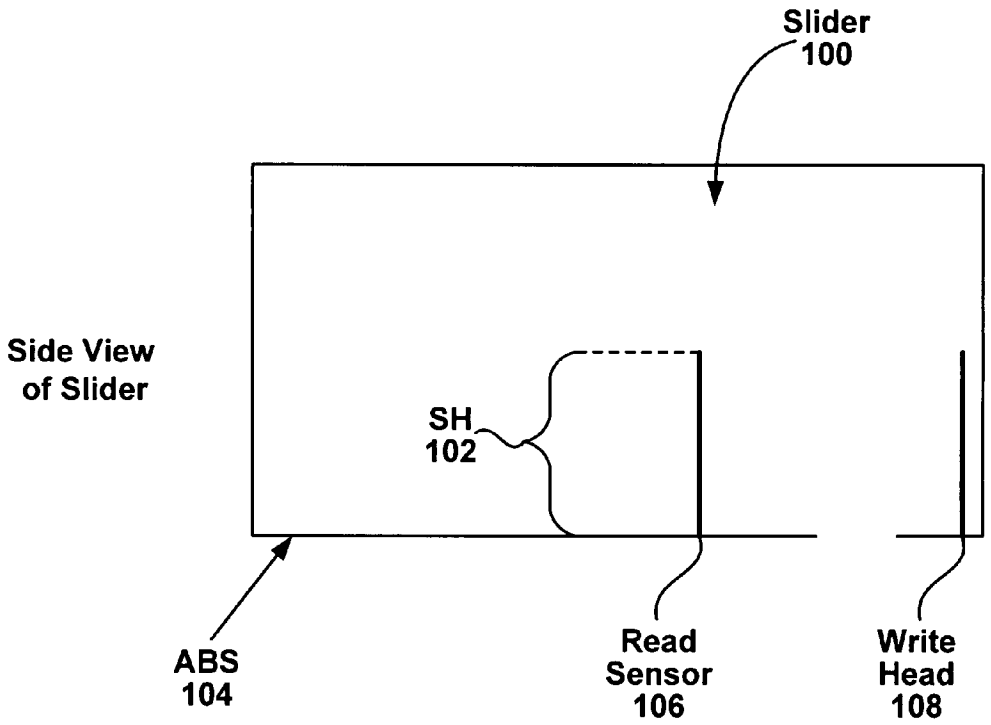
FIG. 1 depicts a side view of a conventional slider.
Figure 2:
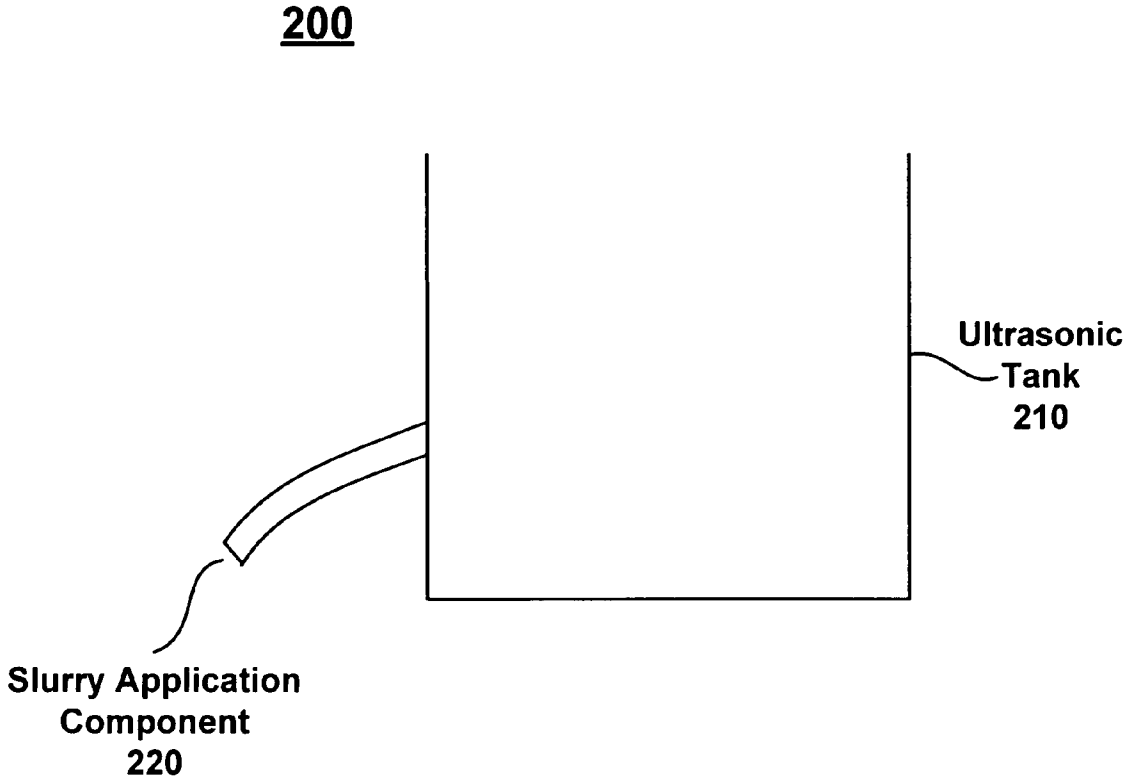
FIG. 2 depicts an ultrasonic mixing device, according to one embodiment.

FIG. 2 depicts an ultrasonic mixing device, according to one embodiment. The ultrasonic mixing device includes an ultrasonic tank and a slurry application component. The features depicted in FIG. 2 can be arranged differently than as illustrated, and can implement additional or fewer features than what are described herein. Further, the features represented by the blocks in FIG. 2 can be combined in various ways.

The ultrasonic tank 210 is used for ultrasonic mixing of the oil-based slurry. The ultrasonic tank 210, according to one embodiment, is a commercially available ultrasonic tank. The ultrasonic tank 210 can be any ultrasonic tank with minimum power density of 90 watts per cubic meter that is capable of ultrasonically mixing at a frequency that is within 20 percent of 30 to 40 kilohertz, according to one embodiment. The ultrasonic tank 210 could be any size. According to one embodiment, a piezo electrical component is attached to the bottom of the ultrasonic tank 210 which can be used to vibrate the ultrasonic tank 210 at a specified frequency. A container of slurry can be placed in the ultrasonic tank 210.

The slurry application component 220 is coupled to the ultrasonic tank 210. The slurry application component 220 is used for applying the oil-based slurry to a lapping plate. According to one embodiment, the slurry application component 220 is a pipe.

USING AN ULTRASONIC MIXING DEVICE

Figure 3:
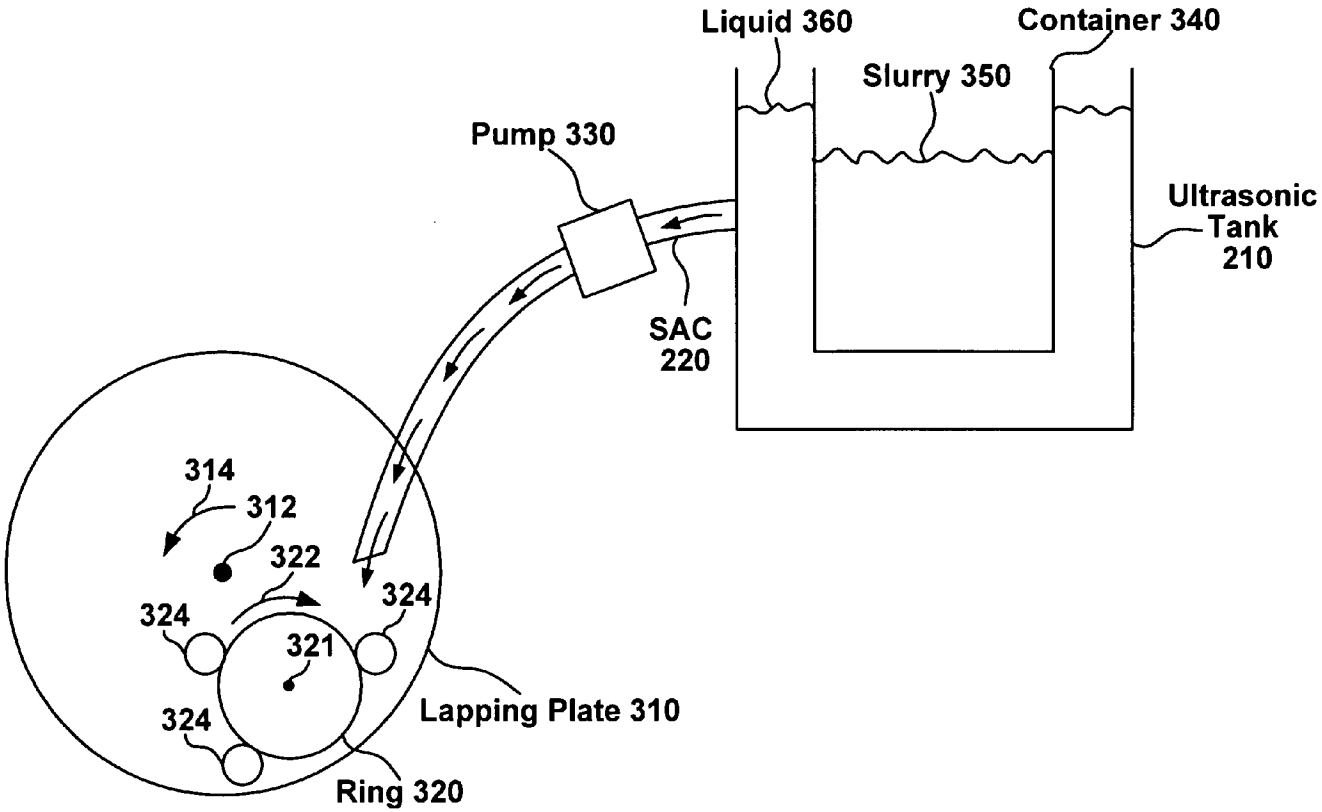
FIG. 3 depicts using an ultrasonic mixing device in conjunction with a part of a charging station while manufacturing a lapping plate, according to one embodiment.

FIG. 3 depicts using an ultrasonic mixing device in conjunction with a part of a charging station while manufacturing a lapping plate, according to one embodiment. The features depicted in FIG. 3 can be arranged differently than as illustrated, and can implement additional or fewer features than what are described herein. Further, the features represented by the blocks in FIG. 3 can be combined in various ways.

The slurry 350 is an oil-based slurry with particles, such as diamonds, of known size. The diamonds are crackable diamonds. Crackable diamonds are purposely manufactured with imperfections that will cause the diamonds to crack, thus re-sharpening the diamonds, during the lapping plate 310 manufacturing process.

The ultrasonic mixing device 200 can be used with a conventional charging station. For example, the ultrasonic mixing device 200 can replace a conventional magnetic stirrer that would be associated with a conventional charging station. A liquid 360 such as water can be put into the ultrasonic tank 210. A container 340 of slurry 350 can be placed in the ultrasonic tank 210 for example by placing the container 340 in the liquid 360. A pump 330 can be coupled to the slurry application component 220 for pumping oil-based slurry 350 onto the lapping plate 310. The lapping plate 310 can be rotated about its axis 312 in the direction indicated by the arrow 314. A variable speed control can be used for varying the rate at which the lapping plate 310 is rotated.

One or more rings 320 can be used as a part of causing particles from the oil-based slurry 350 to be embedded into the lapping plate 310. According to one embedment, a ring 320 can rotate about its axis 321 in the direction indicated by the arrow 322. An arm (not shown) can be attached to the ring 320 and wheels 324 can be in close proximity to the ring 320. The ring 320 can rotate inside of the wheels 324. According to another embodiment, the lapping plate 310 and the ring 320 rotate in different directions as indicated by the arrows 314, 322. The oil-based slurry 350, according to one embodiment, is placed onto the lapping plate 310 in proximity to the ring 320.

The particles in the oil-based slurry 350 can be embedded efficiently into the lapping plate 310 because the mixing separates the diamond particles, which allows the diamond particles to be pushed into the lapping plate by the charge ring, for example. According to one embodiment, the power is within 20 percent of 90 watts per cubic meter in the ultrasonic tank 350. Further, a ring 320 can be used as a part of causing the particles to be embedded into a lapping plate 310. For example, the ring 320 may embed particles when the oil-based slurry 350 goes between the ring 320 and the lapping plate 310.

Figure 4:
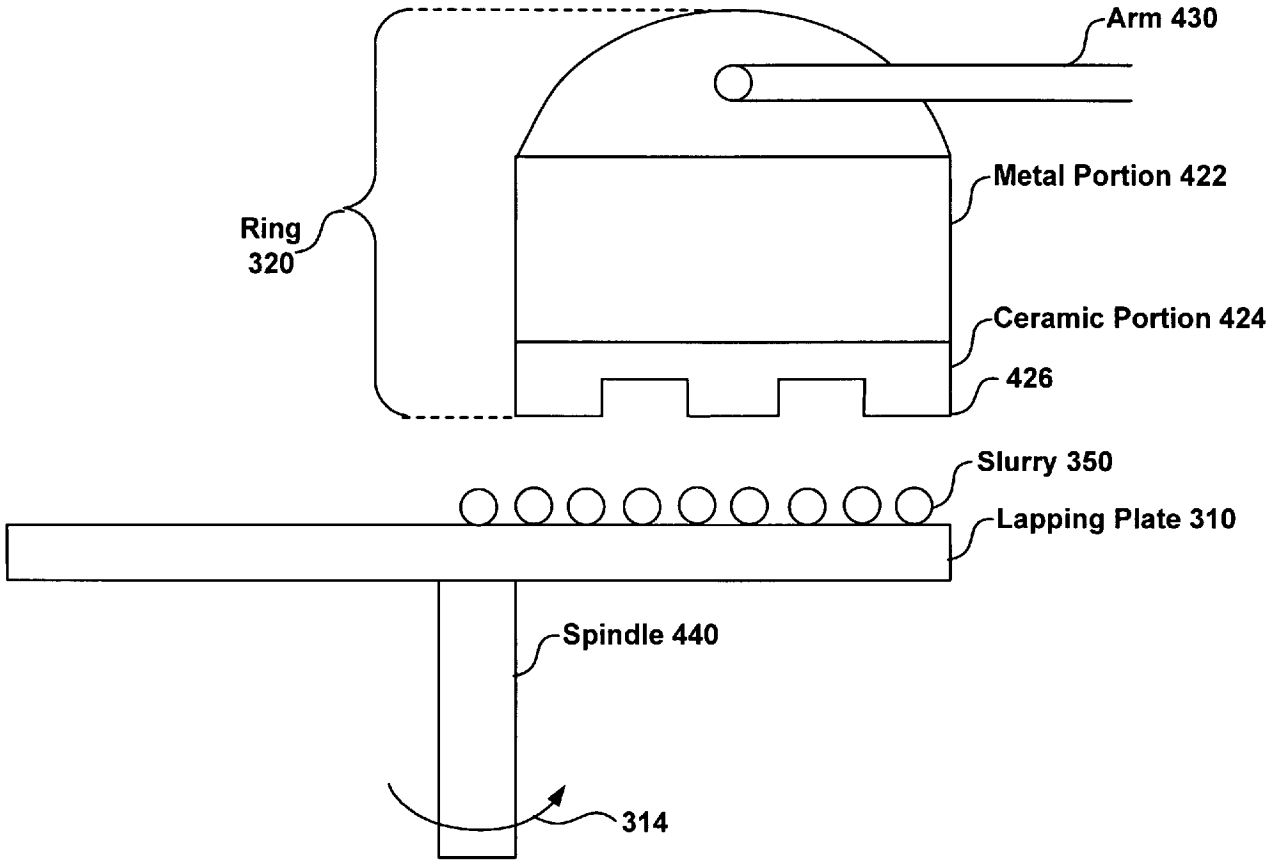
FIG. 4 depicts a side view of a part of a charging station used while manufacturing a lapping plate, according to one embodiment.

FIG. 4 depicts a side view of a part of a charging station used while manufacturing a lapping plate, according to one embodiment. The features depicted in FIG. 4 can be arranged differently than as illustrated, and can implement additional or fewer features than what are described herein. Further, the features represented by the blocks in FIG. 4 can be combined in various ways.

FIG. 4 depicts a ring 320, an arm 430 coupled to the ring 320, a lapping plate 310, a spindle 440, and oil-based slurry 350 that has been applied to the lapping plate 350. The ring 320 includes a metal portion 422 and a ceramic portion 424. The ceramic portion 424 can be pinned to the metal portion 422. The bottom 426 of the ceramic portion 424 is designed for causing particles from the slurry 350 to be embedded into a lapping plate 310. The spindle 440 is used for rotating the lapping plate 310 as indicated by the arrow 314. A lapping plate 310 typically is heavy enough to stabilize it 310 on a spindle 440.

RESULTS

As already stated, tests have been performed on conventional lapping plates 310 with five diameters manufactured with oil-based slurries using conventional techniques to assess the quality of the conventional lapping plates. It was found that on the average the conventional lapping plates had approximately 200 defects along their respective diameters. It was also determined that lapping plates with 100 defects or fewer were of a sufficient quality to lap sliders 100. Therefore only 5% to 10% of the lapping plates were good enough to use for lapping sliders 100. Lapping plates take approximately 2 hours and 40 minutes to manufacture, therefore with only 5% to 10% of the lapping plates passing quality control it would not be possible to manufacture lapping plates using conventional techniques to reduce agglomeration of oil-based slurries. Examples of the conventional techniques that were tried include filtering the oil-based slurry, shaking the oil-based slurry, stirring the oil-based slurry, stirring the oil-based slurry at different speeds, stirring the oil-based slurry continuously, letting the oil-based slurry sit, and heating the oil-based slurry were tried to reduce the amount of particle agglomeration. However, none of these conventional techniques were successful.

Tests were also performed on lapping plates 310 with five inch diameters manufactured using various embodiments of the present invention. Again the defects that could be seen with 100× magnification were counted along the diameter of the lapping plates 310. On the average the lapping plates 310 had approximately 10 defects. Further, the tests indicated that 95 percent of the lapping plates 310 had 50 or fewer defects. Many of the lapping plates 310 even had no defects.

OPERATIONAL EXAMPLE OF A METHOD OF REDUCING AGGLOMERATION OF PARTICLES WHILE MANUFACTURING A LAPPING PLATE USING OIL-BASED SLURRY

Figure 5:
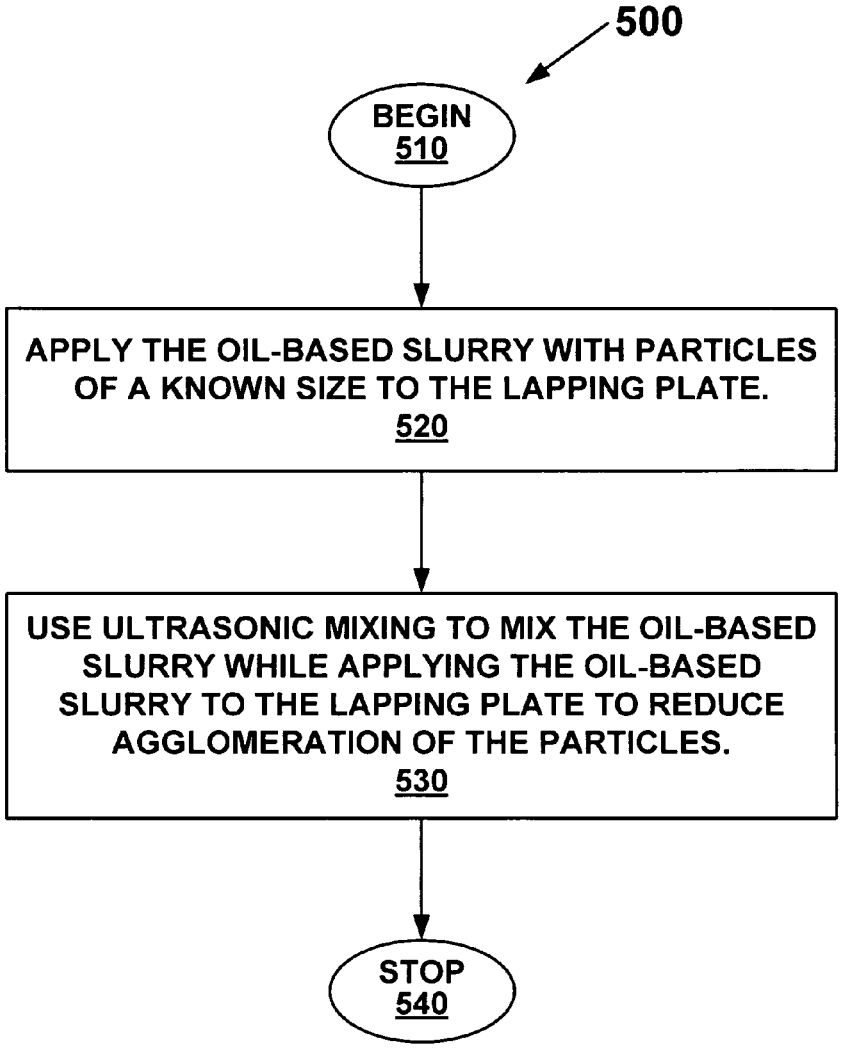
FIG. 5 depicts a flowchart describing a method of reducing agglomeration of particles while manufacturing a lapping plate using an oil-based slurry, according to one embodiment of the present invention.

FIG. 5 depicts a flowchart 500 describing a method of reducing agglomeration of particles while manufacturing a lapping plate using oil-based slurry, according to one embodiment of the present invention. Although specific steps are disclosed in flowchart 500, such steps are exemplary. That is, embodiments of the present invention are well suited to performing various other steps or variations of the steps recited in flowchart 500. It is appreciated that the steps in flowchart 500 may be performed in an order different than presented, and that not all of the steps in flowchart 500 may be performed.

All of, or a portion of, the embodiments described by flowchart 500 can be implemented using computer-readable and computer-executable instructions which reside, for example, in computer-usable media of a computer system or like device. As described above, certain processes and steps of the present invention are realized, in one embodiment, as a series of instructions (e.g., software program) that reside within computer readable memory of a computer system and are executed by the of the computer system. When executed, the instructions cause the computer system to implement the functionality of the present invention as described below.

In step 510, the process begins.

In step 520, an oil-based slurry with particles of known size is applied to a lapping plate. For example referring to FIG. 3, particles may be diamond particles that are crackable. The oil-based slurry 350 can be pumped using a pump 330 out of a container 340 and through a slurry application component 220, which may be a pipe. The oil-based slurry 350 can be applied in proximity to one or more rings 320 associated with a charging station.

In step 530, the oil-based slurry is ultrasonically mixed while the oil-based slurry is applied to the lapping plate. For example still referring to FIG. 3, an ultrasonic tank 210 can be used to ultrasonically mix the oil-based slurry 350 in the container 340 while the oil-based slurry 350 is being applied to the lapping plate 310. The oil-based slurry 350 may be ultrasonically mixed for a while before it 350 is applied to the lapping plate 310. Further, the oil-based slurry 350 may be ultrasonically mixed continuously as it 350 is applied. According to one embodiment, the oil-based slurry 350 is ultrasonically mixed at a frequency that is within 20 percent of 30 to 40 kilohertz. Further, the oil-based slurry 350 is ultrasonically mixed while applying a power within 20 percent of 90 watts per cubic meter of the oil-based slurry 350, according to another embodiment.

In step 540, the process ends.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments described herein were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method of reducing agglomeration of particles while manufacturing a lapping plate using an oil-based slurry, the method comprising:

providing a slurry tank comprising an oil-based slurry disposed within an ultrasonic tank, said oil-based slurry not in direct contact with the ultrasonic tank;

generating an ultrasonic wave inside said ultrasonic tank and outside said slurry tank;

applying the oil-based slurry with particles of a known size to the lapping plate; and using ultrasonic mixing to mix the oil-based slurry while applying the oil-based slurry to the lapping plate to reduce agglomeration of the particles, wherein the ultrasonic mixing device works with a conventional charging station.

2. The method as recited in claim 1, wherein the using of the ultrasonic mixing to mix the oil-based slurry further comprises:

using a relatively low frequency to ultrasonically mix the oil-based slurry.

3. The method as recited in claim 2, wherein the using of a relatively low frequency to ultrasonically mix the oil-based slurry further comprises:

using a relatively low frequency that is within 20 percent of 40 kilohertz.

4. The method as recited in claim 1, wherein the applying the oil-based slurry with the particles of the known size to the lapping plate further comprises:

using a relatively low power to enable the particles to be embedded into the lapping plate.

5. The method as recited in claim 4, wherein the using of the relatively low power further comprises:

using a power that is within 20 percent of 90 watts per cubic meter of the oil-based slurry.

6. The method as recited in claim 1, wherein the using of the ultrasonic mixing to mix the oil-based slurry further comprises:

continuously using ultrasonic mixing to mix the oil-based slurry during the applying of the oil-based slurry.

7. The method as recited in claim 1, wherein the using of the ultrasonic mixing to mix the oil-based slurry further comprises:

using a commercially available ultrasonic tank to mix the oil-based slurry.

8. An ultrasonic mixing device for reducing agglomeration of particles while manufacturing a lapping plate using an oil-based slurry, the ultrasonic mixing device comprising:

a slurry tank disposed within an ultrasonic tank, said slurry tank containing an oil-based slurry and said oil-based slurry not in direct contact with the ultrasonic tank;

said ultrasonic tank comprising an ultrasonic wave generation device coupled to the interior of said tank for generating an ultrasonic wave outside said slurry tank for inducing ultrasonic mixing of the oil-based slurry, wherein the oil-based slurry includes particles of known size and wherein the ultrasonic mixing reduces agglomeration of the particles and wherein the ultrasonic mixing device works with a conventional charging station; and a slurry application component coupled to the ultrasonic tank, wherein the slurry application component is for applying the oil-based slurry to the lapping plate.

9. The ultrasonic mixing device of claim 8, wherein a relatively low frequency is used for ultrasonic mixing of the oil-based slurry.

10. The ultrasonic mixing device of claim 9, wherein the relatively low frequency is within 20 percent of 40 kilohertz.

11. The ultrasonic mixing device of claim 9, wherein the relatively low frequency is within 20 percent of 30 kilohertz.

12. The ultrasonic mixing device of claim 8, wherein a relatively low power is used as a part of causing the particles to be embedded into the lapping plate.

13. The ultrasonic mixing device of claim 12, wherein the relatively low power is within 20 percent of 90 watts per cubic meter of the oil-based slurry.

14. The ultrasonic mixing device of claim 8, wherein the ultrasonic tank continuously mixes the oil-based slurry while the slurry application component is being used for applying of the oil-based slurry.

15. The ultrasonic mixing device of claim 8, wherein the ultrasonic tank is a commercially available ultrasonic tank.

16. The ultrasonic mixing device of claim 8, wherein the ultrasonic mixing device is used instead of a conventional magnetic stirrer.

* * * * *